US006018837A

United States Patent [19]

Andreu

[11] Patent Number: 6,018,837

[45] Date of Patent: Feb. 1, 2000

[54] CLEANING AND SCOURING GLOVE

[76] Inventor: Elizabeth M. Andreu, 23243 Hollander, Dearborn, Mich. 48128

[21] Appl. No.: 09/109,721

[22] Filed: Jul. 2, 1998

[51] Int. Cl.[7] ..... A47K 7/02

[52] U.S. Cl. ..... 15/118; 15/104.94; 15/227

[58] Field of Search ..... 15/104.94, 227, 15/244.1, 229.11, 118; 2/159, 161.6, 161.8

[56] References Cited

U.S. PATENT DOCUMENTS

| | | | |
|---|---|---|---|
| 2,227,707 | 1/1941 | Cooper | 15/227 |
| 2,745,128 | 5/1956 | Zeuner | 15/244.1 |
| 3,643,386 | 2/1972 | Grzyll | 15/227 |
| 4,593,427 | 6/1986 | Ortolivo | 15/227 |
| 4,621,388 | 11/1986 | Ortolivo | 15/227 |
| 5,441,355 | 8/1995 | Moore | 15/227 |

FOREIGN PATENT DOCUMENTS

| | | | |
|---|---|---|---|
| 2 582 196 | 11/1986 | France | 15/227 |
| 2 582 212 | 11/1986 | France | 15/227 |
| 2 676 637 | 11/1992 | France | 15/227 |
| 2 702 947 | 9/1994 | France | 15/227 |
| 2 113 977 | 8/1983 | United Kingdom . | |

*Primary Examiner*—Mark Spisich
*Assistant Examiner*—Theresa T. Snider

[57] ABSTRACT

A Cleaning and Scouring Glove for providing a waterproof glove useful for scrubbing and cleaning. The inventive device includes a waterproof glove including a palm portion, a back portion, finger stalls, and a thumb stall cooperatively joined together to fit a wearer's hand. A generally flexible scouring material is disposed on each of the finger stalls and the thumb stall, and a generally flexible absorptive material is provided on the palm portion of the glove thereby facilitating different types of washing actions with the same glove.

12 Claims, 2 Drawing Sheets

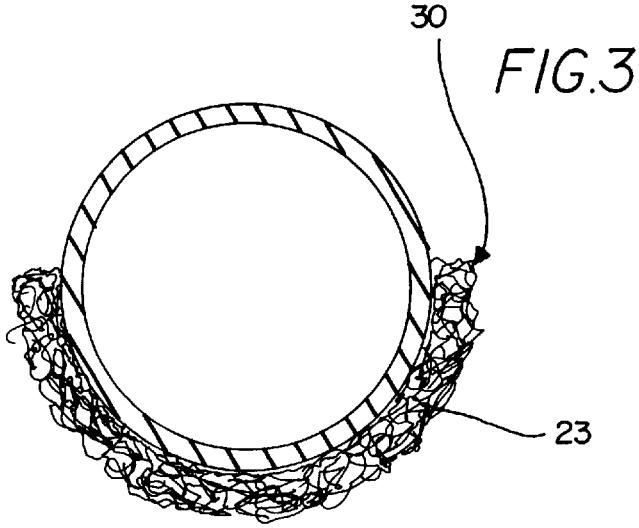
FIG.3
FIG.4
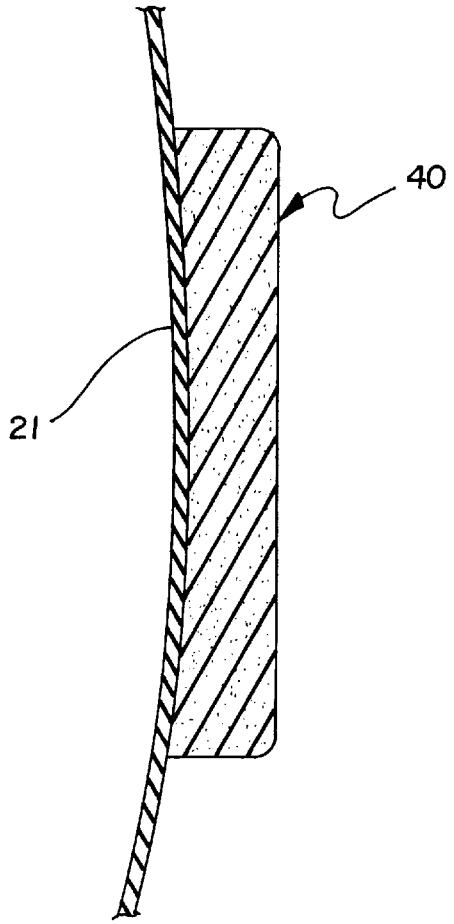

CLEANING AND SCOURING GLOVE

BACKGROUND OF THE INVENTION

1. Field of the Invention

The present invention relates to gloves and more particularly pertains to a Cleaning and Scouring Glove for providing a waterproof glove useful for scrubbing and cleaning.

2. Description of the Prior Art

The use of gloves is known in the prior art. More specifically, gloves heretofore devised and utilized are known to consist basically of familiar, expected and obvious structural configurations, notwithstanding the myriad of designs encompassed by the crowded prior art which have been developed for the fulfillment of countless objectives and requirements.

Known prior art gloves include U.S. Pat. No. 4,621,388; U.S. Pat. No. 3,885,249; U.S. Pat. No. 4,051,572; U.S. Pat. No. 4,593,427; U.S. Pat. No. D268,968; and U.S. Pat. No. D349,373.

While these devices fulfill their respective, particular objectives and requirements, the aforementioned patents do not disclose a new Cleaning and Scouring Glove. The inventive device includes a waterproof glove including a palm portion, a back portion, finger stalls, and a thumb stall cooperatively joined together to fit a wearer's hand. A generally flexible scouring material is disposed on each of the finger stalls and the thumb stall, and a generally flexible absorptive material is provided on the palm portion of the glove thereby facilitating different types of washing actions with the same glove.

In these respects, the Cleaning and Scouring Glove according to the present invention substantially departs from the conventional concepts and designs of the prior art, and in so doing provides an apparatus primarily developed for the purpose of providing a waterproof glove useful for scrubbing and cleaning.

SUMMARY OF THE INVENTION

In view of the foregoing disadvantages inherent in the known types of gloves now present in the prior art, the present invention provides a new Cleaning and Scouring Glove construction wherein the same can be utilized for providing a waterproof glove useful for scrubbing and cleaning.

The general purpose of the present invention, which will be described subsequently in greater detail, is to provide a new Cleaning and Scouring Glove apparatus and method which has many of the advantages of the gloves mentioned heretofore and many novel features that result in a new Cleaning and Scouring Glove which is not anticipated, rendered obvious, suggested, or even implied by any of the prior art gloves, either alone or in any combination thereof.

To attain this, the present invention generally comprises a waterproof glove including a palm portion, a back portion, finger stalls, and a thumb stall cooperatively joined together to fit a wearer's hand. A generally flexible scouring material is disposed on each of the finger stalls and the thumb stall, and a generally flexible absorptive material is provided on the palm portion of the glove thereby facilitating different types of washing actions with the same glove.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Cleaning and Scouring Glove apparatus and method which has many of the advantages of the gloves mentioned heretofore and many novel features that result in a new Cleaning and Scouring Glove which is not anticipated, rendered obvious, suggested, or even implied by any of the prior art gloves, either alone or in any combination thereof.

It is another object of the present invention to provide a new Cleaning and Scouring Glove which may be easily and efficiently manufactured and marketed.

It is a further object of the present invention to provide a new Cleaning and Scouring Glove which is of a durable and reliable construction.

An even further object of the present invention is to provide a new Cleaning and Scouring Glove which is susceptible of a low cost of manufacture with regard to both materials and labor, and which accordingly is then susceptible of low prices of sale to the consuming public, thereby making such Cleaning and Scouring Glove economically available to the buying public.

Still yet another object of the present invention is to provide a new Cleaning and Scouring Glove which provides in the apparatuses and methods of the prior art some of the advantages thereof, while simultaneously overcoming some of the disadvantages normally associated therewith.

Still another object of the present invention is to provide a new Cleaning and Scouring Glove for providing a waterproof glove useful for scrubbing and cleaning.

Yet another object of the present invention is to provide a new Cleaning and Scouring Glove which includes a waterproof glove including a palm portion, a back portion, finger stalls, and a thumb stall cooperatively joined together to fit a wearer's hand. A generally flexible scouring material is disposed on each of the finger stalls and the thumb stall, and a generally flexible absorptive material is provided on the palm portion of the glove thereby facilitating different types of washing actions with the same glove.

Still yet another object of the present invention is to provide a new Cleaning and Scouring Glove that can be used for cleaning without the need for a separate scouring pad or dishcloth, which can easily slip from the user's grasp.

Even still another object of the present invention is to provide a new Cleaning and Scouring Glove that gives the user greater control and flexibility while cleaning dishes, pots and pans, countertops, etc.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is a cross sectional view taken along line 4—4 of FIG. 2.

DESCRIPTION OF THE PREFERRED EMBODIMENT

Figure 1:
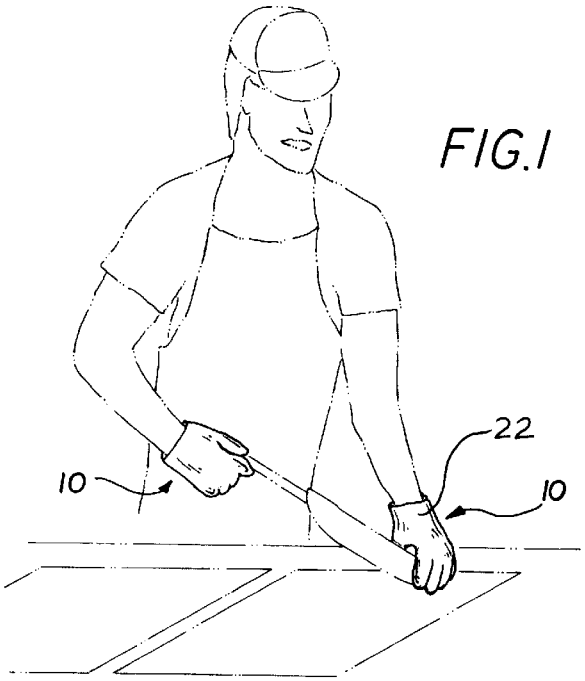
FIG. 1 is an illustration of a new Cleaning and Scouring Glove in use according to the present invention.
Figure 2:
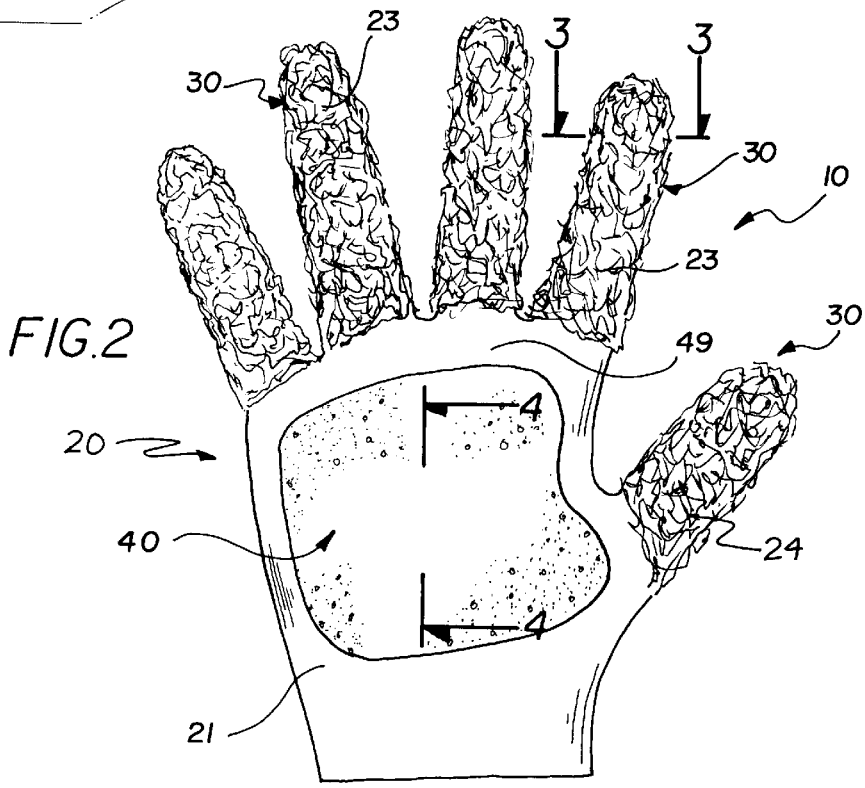
FIG. 2 is an illustration of the palm side of the present invention.

With reference now to the drawings, and in particular to FIGS. 1 through 4 thereof, a new Cleaning and Scouring Glove embodying the principles and concepts of the present invention and generally designated by the reference numeral 10 will be described.

As best illustrated in FIGS. 1 through 4, the Cleaning and Scouring Glove 10 comprises a waterproof glove 20 including a palm portion 21, a back portion 22, finger stalls 23, and a thumb stall 24 cooperatively joined together to fit a wearer's hand. A generally flexible scouring material 30 is disposed on each of the finger stalls 23 and the thumb stall 24, and a generally flexible absorptive material 40 is provided on the palm portion 21 of the glove 20 thereby facilitating different types of washing actions with the same Cleaning and Scouring Glove 10. In an optional embodiment, the absorptive material 40 is provided on each of the finger stalls 23 and the thumb stall 24 as well as the palm portion 21 of the glove 20.

As best illustrated in FIGS. 1 through 4, it can be shown that the glove 20 includes a palm portion 21 covering the palm of the wearer's hand and a back portion 22 overlying the back of the wearer's hand. The glove 20 includes finger stalls 23 and a thumb stall 24 for receiving the fingers and the thumb, respectively, of the wearer's hand. Preferably, the glove 20 is formed of a flexible waterproof material such as latex rubber.

The scouring material 30 is affixed to an exterior surface of each of the finger stalls 23 and an exterior surface of the thumb stall 24. In a first embodiment, the scouring material 30 entirely covers each of the finger stalls 23 and the thumb stall 24. In a second embodiment, however, the scouring material 30 only covers a palm side and the sides of each of the finger stalls 23 and the thumb stall 24. Preferably, the scouring material 30 is a generally flexible scouring material such as that marketed under the trademarked name SCOTCH-BRITE.

The absorptive material 40 is affixed to an exterior surface of the palm portion 21 of the glove 20 and covers substantially the entire palm portion 21. However, a gap 49 is provided between the scouring material 30 disposed on each of the finger stalls 23 and the thumb stall 24 and the absorptive material 40 so as to maintain flexibility of the glove 20. The absorptive material 40 is generally flexible so as to permit substantial clinching of the fist of the wearer. Preferably, the absorptive material 40 is a sponge having a porous, generally flexible skeletal structure including a plurality of pores, wherein the plurality of pores of the sponge are capable of absorbing and holding a cleaning solution.

In use, a wearer of the Cleaning and Scouring Glove 10 inserts his or her fingers into the finger stalls 23 and his or her thumb into the thumb stall 24. As such, the wearer may conveniently scrub and wash dishes, pots and pans, countertops, etc. without the need for a separate scouring pad or dishcloth. Furthermore, the wearer may perform both types of washing actions with the same Cleaning and Scouring Glove 10.

Other optional embodiments of the invention include disposing the absorptive material on all of the finger stalls, or employing absorptive material on some of the finger stalls and scouring material on other finger stalls, most preferably in an alternating finger stall arrangement. Also, the scouring material may be located on one portion of a finger stall with the absorptive material located on the another portion of the finger stall. Also optionally, the glove may take the form where one or more of the finger stalls are merged together, such as is commonly referred to as a "mitten", although this is less preferred because of the relatively lesser grippability of the mitten configuration and the lack of ability to get into smaller areas for cleaning of the mitten configuration.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A cleaning and scouring glove, comprising:

a waterproof glove including a palm portion, a back portion, finger stalls, and a thumb stall cooperatively joined together to fit a wearer's hand;

a generally flexible scouring material disposed on each of said finger stalls and said thumb stall of said glove; and a generally flexible absorptive material provided oil said palm portion of said glove;

wherein said absorptive material is affixed to an exterior surface of said palm portion; and wherein a gap is provided between said Scouring material and said absorptive material thereby maintaining flexibility of said glove.

2. The cleaning and scouring glove of claim 1, wherein said scouring material is affixed to an exterior surface of each of said finger stalls and an exterior surface of said thumb stall, said scouring material entirely covering each of said finger stalls and said thumb stall.

3. The cleaning and scouring glove of claim 1, wherein said scouring material is affixed to an exterior surface of each of said finger stalls and an exterior surface of said thumb stall, said scouring material covering only a palm side and the sides of each of said finger stalls and said thumb stall.

4. The cleaning and scouring of claim 1, wherein said absorptive material substantially covers said palm portion of said glove.

5. The cleaning and scouring glove of claim 1, wherein said absorptive material is adapted for absorbing and holding a cleaning solution.

6. A cleaning and scouring glove, comprising:

a waterproof glove including a palm portion, a back portion, finger stalls, and a thumb stall cooperatively joined together to fit a wearer's hand:

a generally flexible scouring material disposed on each of said finger stalls and said thumb stall of said glove; and a generally flexible absorptive material provided on said palm portion of said glove;

wherein said absorptive material is affixed to an exterior surface of said palm portion, said absorptive material substantially covering said palm portion of said glove; and wherein a gap is provided between said scouring material and said absorptive material thereby maintaining flexibility of said glove.

7. The cleaning and scouring glove of claim 6, wherein said scouring material is affixed to an exterior surface of each of said finger stalls and an exterior surface of said thumb stall, said scouring material entirely covering each of said finger stalls and said thumb stall.

8. The cleaning and scouring glove of claim 6, wherein said scouring material is affixed to an exterior surface of each of said finger stalls and an exterior surface of said thumb stall, said scouring material covering only a palm side and the sides of each of said finger stalls and said thumb stall.

9. The cleaning and scouring glove of claim 6, wherein said absorptive material is adapted for absorbing and holding a cleaning solution.

10. A cleaning and scouring glove, comprising:

a waterproof glove including a palm portion, a back portion, finger stalls, and a thumb stall cooperatively joined together to fit a wearer's hand;

a generally flexible scouring material affixed to an exterior surface of each of said finger stalls and an exterior surface of said thumb stall of said glove; and a generally flexible absorptive material affixed to an exterior surface of said palm portion and adapted for absorbing a cleaning solution, said absorptive material substantially covering said palm portion of said glove, wherein said scouring material and said absorptive material are separated by a gap extending along a base of each of said finger stalls and along a base of said thumb stall.

11. The cleaning and scouring glove of claim 10, wherein said scouring material entirely covers each of said finger stalls and said thumb stall.

12. The cleaning and scouring glove of claim 10, wherein said scouring material covers only a palm side and the sides of each of said finger stalls and said thumb stall.

* * * * *